US008469155B2

(12) United States Patent
Thomsen et al.

(10) Patent No.: US 8,469,155 B2
(45) Date of Patent: Jun. 25, 2013

(54) ELEVATOR LIFE SAFETY GATE

(75) Inventors: Christian E. Thomsen, Seattle, WA (US); Robert D. Wilson, Jr., Seattle, WA (US); James Watson, Seattle, WA (US); Keegan Carriveau, Seattle, WA (US); Max Wilson, Seattle, WA (US)

(73) Assignee: Vertical Motion Innovations, LLC, Seattle, WA (US)

( * ) Notice: Subject to any disclaimer, the term of this patent is extended or adjusted under 35 U.S.C. 154(b) by 0 days.

(21) Appl. No.: 13/398,778

(22) Filed: Feb. 16, 2012

(65) Prior Publication Data

US 2012/0205197 A1 Aug. 16, 2012

Related U.S. Application Data

(60) Provisional application No. 61/443,275, filed on Feb. 16, 2011.

(51) Int. Cl.

| | |
|---|---|
| ***B66B 11/02*** | (2006.01) |
| ***B66B 13/28*** | (2006.01) |
| ***B66B 1/34*** | (2006.01) |
| ***E06B 3/68*** | (2006.01) |

(52) U.S. Cl.

USPC ..... 187/401; 187/394; 187/400; 49/54; 49/125

(58) Field of Classification Search

USPC ..... 187/400, 401, 342, 334, 335; 200/61.44; 49/54, 56, 125, 378

IPC ..... B66B 13/28,13/24, 13/00, 11/00

See application file for complete search history.

(56) References Cited

U.S. PATENT DOCUMENTS 4,556,129 A * 12/1985 Martin ..... 187/279
5,609,224 A * 3/1997 Baggot ..... 187/313

(Continued)

FOREIGN PATENT DOCUMENTS

GB 2453868 A * 4/2009
JP 53075650 A * 7/1978
JP 05319746 A * 12/1993

OTHER PUBLICATIONS

AIPN, Machine Translation, JP05319746A, Nov. 21, 2012, 3 Pages.*

(Continued)

*Primary Examiner* — Michael Mansen
*Assistant Examiner* — Stefan Kruer
(74) *Attorney, Agent, or Firm* — Puget Patent; Michael Gibbons

(57) ABSTRACT

A gate below an elevator car which prevents access to an elevator hoistway. The gate slidably mounts behind a toe guard and retracts upwardly if the bottom of the gate encounters a person, object or the floor of the elevator pit during downward travel of the elevator. The gate latches when fully retracted so that it may be out of the way during maintenance. A microswitch is wired into the emergency stop circuit that engages when the gate is latched. A trip wire defining the bottom edge of the gate is also wired into the emergency stop circuit, so that the elevator will stop its downward travel if it encounters an obstruction. Rubber bumpers on the bottom edge of the gate cushion impact to people or objects who happen to be below the elevator car and are struck by the gate during downward elevator movement.

19 Claims, 12 Drawing Sheets

U.S. PATENT DOCUMENTS

| | | | | |
|---|---|---|---|---|
| 5,655,628 | A * | 8/1997 | Lin | 187/414 |
| 6,257,556 | B1 * | 7/2001 | Park | 256/1 |
| 6,318,509 | B1 * | 11/2001 | Spieler et al. | 187/401 |
| 6,739,432 | B2 * | 5/2004 | Elsener | 187/401 |
| 7,350,627 | B2 * | 4/2008 | Ketonen et al. | 187/400 |
| 2004/0195049 | A1 * | 10/2004 | Stobo et al. | 187/401 |
| 2008/0230327 | A1 * | 9/2008 | Cabanas Falcon et al. | 187/400 |
| 2009/0277725 | A1 * | 11/2009 | Rasanen et al. | 187/400 |

OTHER PUBLICATIONS web—definition of web by the Free Online Dictionary, Thesaurus and Encyclopedia; http://www.thefreedictionary.com/p/web; p. 1 or 4; Items 12-13.*

ASME, Safety Code for Elevator and Escalators, A17.1-2007, p. 61 (Source: Kone, Inc., Licensed Jun. 27, 2007).*

* cited by examiner

DEPICTION OF PRIOR ART

ELEVATOR LIFE SAFETY GATE

PRIORITY CLAIM

This invention claims the benefit of U.S. provisional patent application Ser. No. 61/443,275 filed Feb. 16, 2011. The foregoing application is incorporated by reference in its entirety as if fully set forth herein.

FIELD OF THE INVENTION

This invention relates generally to elevators, and more specifically, to an elevator life safety gate.

SUMMARY

This invention relates generally to elevators, and more specifically, to an elevator life safety gate. In some embodiments, an elevator life safety gate extends from the bottom of an elevator car. The elevator life safety gate may be further configured for completely blocking access to the elevator hoistway. In some embodiments, an elevator life safety gate may have a front face comprising a webbing, which may be a lattice of straps, where the fabric is nylon or another lightweight, durable material. A webbing facilitates escape from an elevator car by acting as a ladder, permitting occupants to climb down to the landing.

In some embodiments, an elevator life safety gate may extend and retract on rails. In some embodiments, an elevator life safety gate is slidably mounted and may retract upwardly behind an elevator toe guard.

In some embodiments, an elevator life safety gate may have at least a frame, slide rails mounted to the frame, slide guides mounted to side mount rails, the slide guides configured for receiving the slide rails, a top mount rail, an anti-derailment bar, a rear lining, and a hook-and-loop fastener for the rear lining. In some embodiments, a frame of an elevator life safety gate may be a hollow frame, comprising four bars coupled together defining a generally rectangular gate having an aperture in the center. The hollow frame of the elevator life safety gate may reduce overall weight of the gate, permitting its installation without requiring rebalancing of the elevator car with an elevator counterweight. The hollow frame of the elevator life safety gate may also facilitate use of the webbing of the gate as a ladder. In some embodiments, a bottom bar of the frame is supplemented with a trip wire disposed below the bottom bar.

In some embodiments, an elevator life safety gate may have a top gate catch, and a microswitch. In some embodiments, an elevator life safety gate may latch into place with the top gate catch when reaching a fully retracted position. In some embodiments, a microswitch may engage when the top gate catch engages, signaling the elevator emergency stop switch.

BRIEF DESCRIPTION OF THE DRAWINGS

Embodiments of the present invention are described in detail below with reference to the following drawings.

DETAILED DESCRIPTION

This invention relates generally to elevators, and more specifically, to an elevator life safety gate. Specific details of certain embodiments of the invention are set forth in the following description and FIGS. 1-10 to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1A:
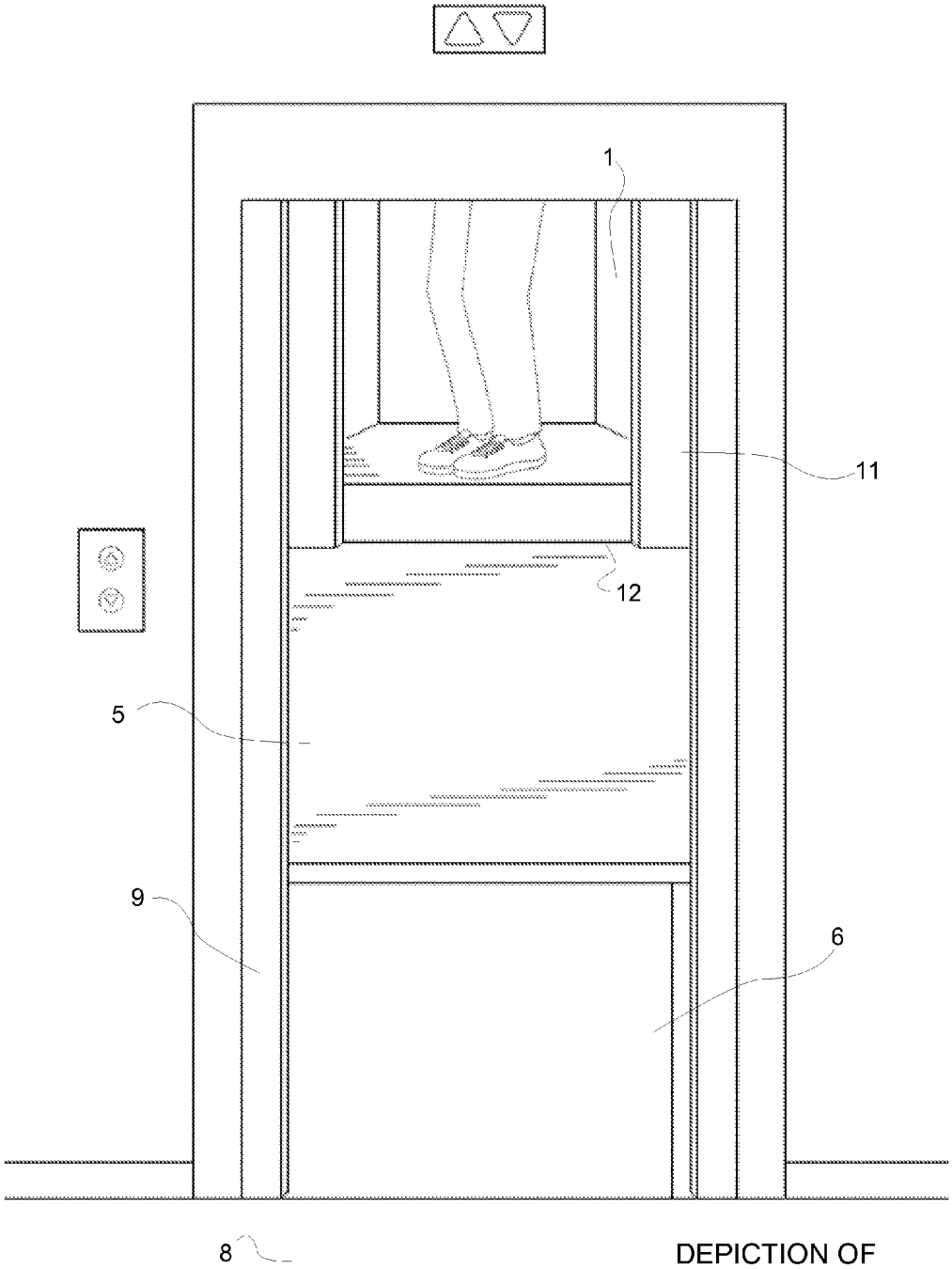
FIG. 1*a* is a depiction of the prior art.

FIG. 1*a* is a depiction of the prior art. An elevator car 1 may become stalled above or below a landing 8. Should the hallway doors 9 and elevator car doors 11 be opened, the elevator hoistway 6 may be accessible below the bottom of the elevator car 12. An accessible elevator hoistway is a life-threatening safety condition. Elevators may have a toe guard 5 mounted below the elevator car 1, and the toe guard 5 may partially block access to the elevator hoistway 6. However, depending on the size of the toe guard 5 and where the elevator car 1 is stalled relative to a landing 8, a portion of the hoistway 6 may still be accessible even when a toe guard 5 is used.

Figure 1B:
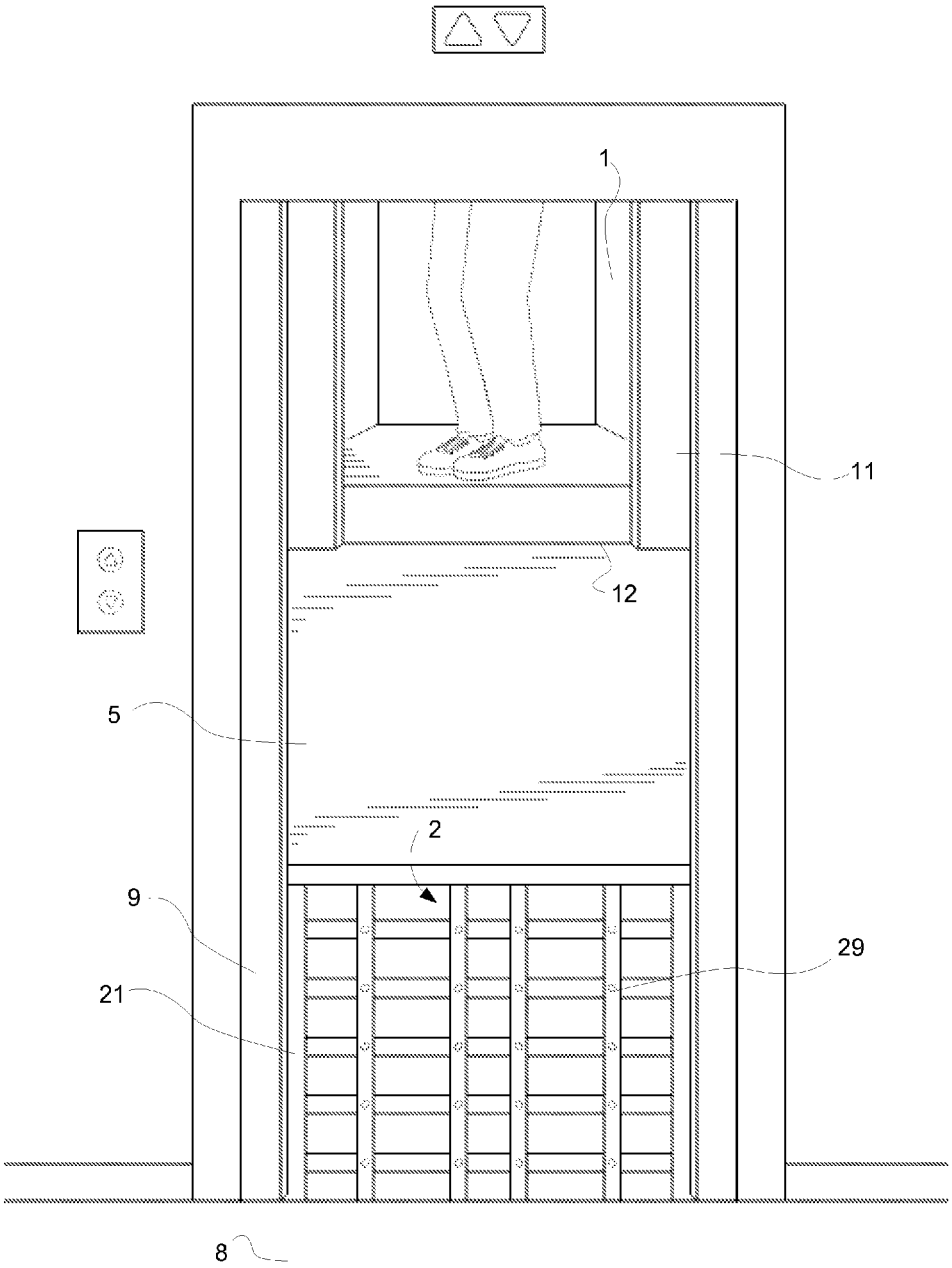
FIG. 1*b* is a front view of an elevator life safety gate, in accordance with an embodiment of the invention.

FIG. 1*b* is a front view of an elevator life safety gate, in accordance with an embodiment of the invention. In some embodiments of the invention, an elevator life safety gate 2 may be configured to extend from underneath an elevator car 1. In some embodiments, the elevator life safety gate extends from the bottom of an elevator car 12. The elevator life safety gate 2 may be further configured for completely blocking access to the elevator hoistway (the elevator hoistway not visible in FIG. 1*b* because it is behind the elevator life safety gate 2). In some embodiments, an elevator life safety gate 2 may have a front face 21. In some embodiments, the front face 21 comprises a webbing 29. A webbing 29 may be a lattice of straps, where the fabric is nylon or another lightweight, durable material. A webbing 29 facilitates escape from an elevator car 1 by acting as a ladder, permitting occupants to climb down to the landing 8.

In some embodiments, an elevator life safety gate 2 is at least as wide as the width of the opening between the landing 8 and the elevator hoistway. In other embodiments, an elevator life safety gate 2 is at least as wide as the hallway doors 9. In different embodiments, multiple life safety gates may be installed side-by-side such that the width of the plurality of life safety gates is at least as wide as the width of the opening between the landing 8 and the elevator hoistway.

In some embodiments, when extended, the elevator life safety gate 2 is at least as tall as the height of the tallest opening between the landing 8 and the elevator hoistway. In different embodiments, the combination of the toe guard 5 and life safety gate 2 is at least as tall as the height of the tallest opening between the landing 8 and the elevator hoistway.

In some embodiments, where an elevator car 1 has elevator car doors 11 on multiple sides of the elevator car 1 (e.g. elevator car doors in the front and the back of the elevator car), multiple elevator life safety gates 2 may be configured to extend from underneath an elevator car 1, from beneath each elevator car door 11 of the elevator car 1.

Figure 2:
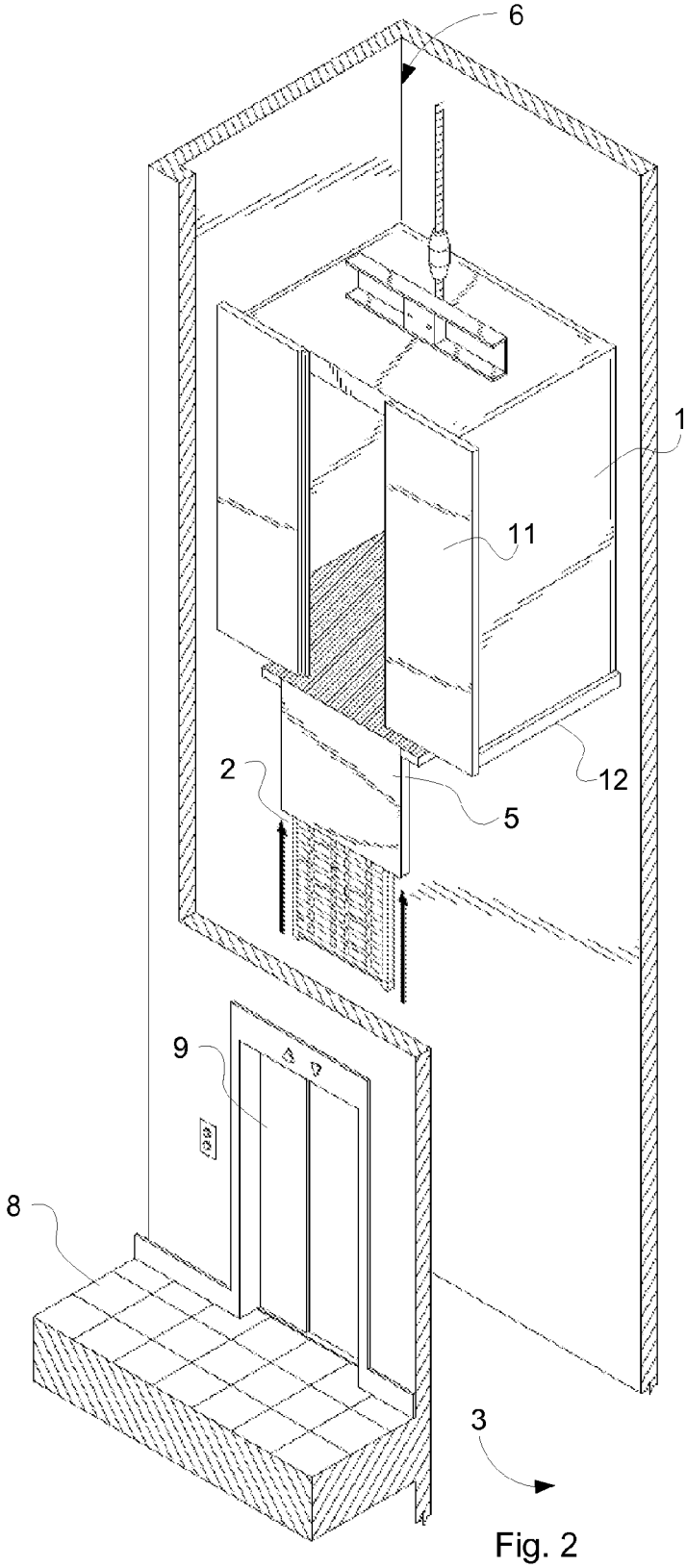
FIGS. 2 and 3 are perspective views of an elevator life safety gate, in accordance with an embodiment of the invention.
Figure 3:
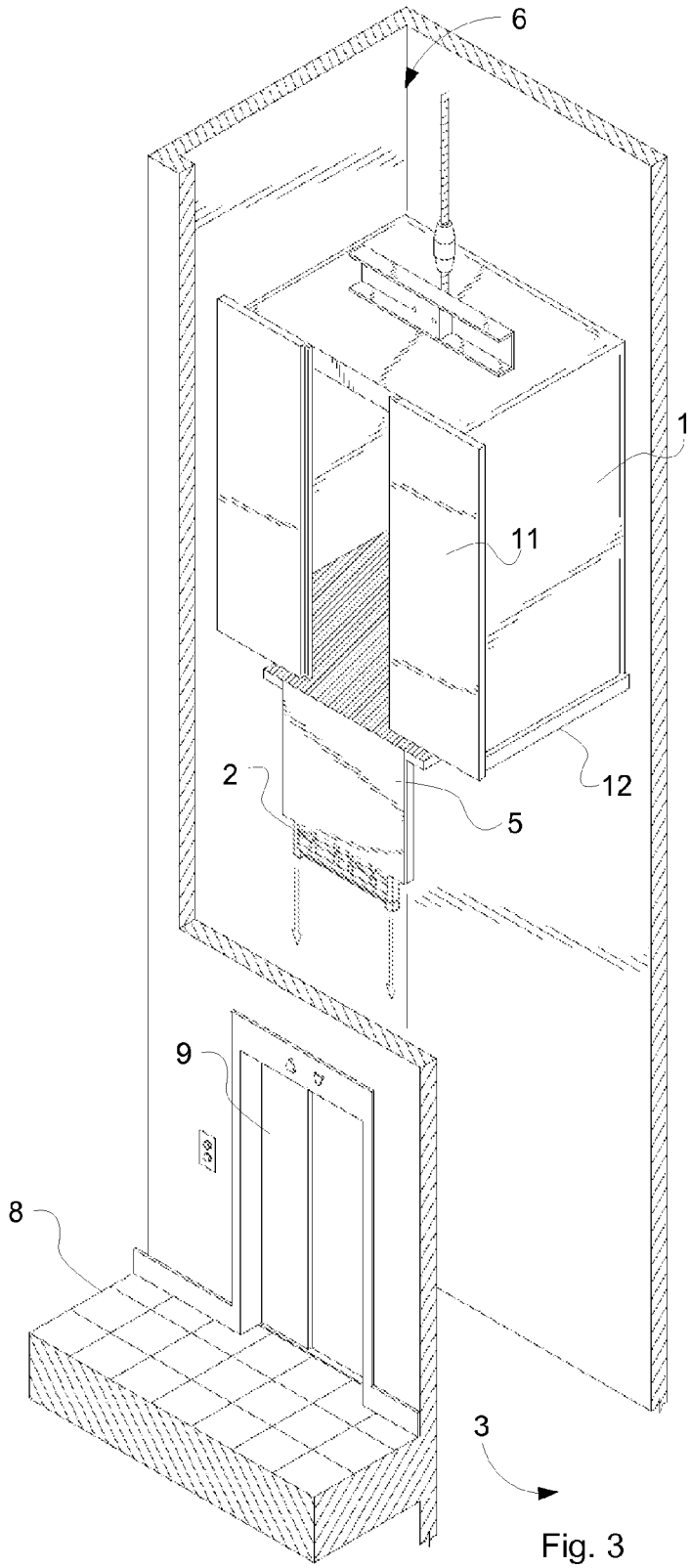

FIGS. 2 and 3 are perspective views of an elevator life safety gate, in accordance with an embodiment of the invention. In some embodiments, an elevator life safety gate 2 extends from the bottom of the elevator car 12. In some embodiments, an elevator life safety gate 2 extends from beneath the elevator car 1. In some embodiments, an elevator life safety gate 2 retractably extends from beneath the elevator car 1. An elevator hoistway 6 may have an elevator pit 3 at the bottom of the elevator hoistway 6, the depth of the elevator pit normally being at least deep enough to accommodate an elevator toe guard 5, when installed. An elevator life safety gate 2 is configurable to retractably extend from beneath the elevator car 1 in order to retract when the elevator car 1 is at the lowest position in the hoistway 6, so that the elevator life safety gate 2 may at least retract when it comes into contact with the elevator pit 3.

In some embodiments, an elevator life safety gate 2 may extend and retract on rails. In some embodiments, an elevator life safety gate 2 may retract upwards, underneath the elevator car 1 and towards the inside of the elevator hoistway 6, retracting like a garage door being opened, parallel to the bottom of the elevator car 12. In a preferred embodiment, an elevator life safety gate 2 is slidably mounted and may retract upwardly behind an elevator toe guard 5. Most elevator toe guards have nothing mounted to them on the hoistway side, so the hoistway side of an elevator toe guard is an advantageous spot for mounting an elevator life safety gate. Further, the elevator life safety gate can be retrofitted to existing elevator toe guards, and thus has universal application. In different embodiments, an elevator life safety gate 2 may collapse, telescope, compress, condense, or compact.

Figure 4A:
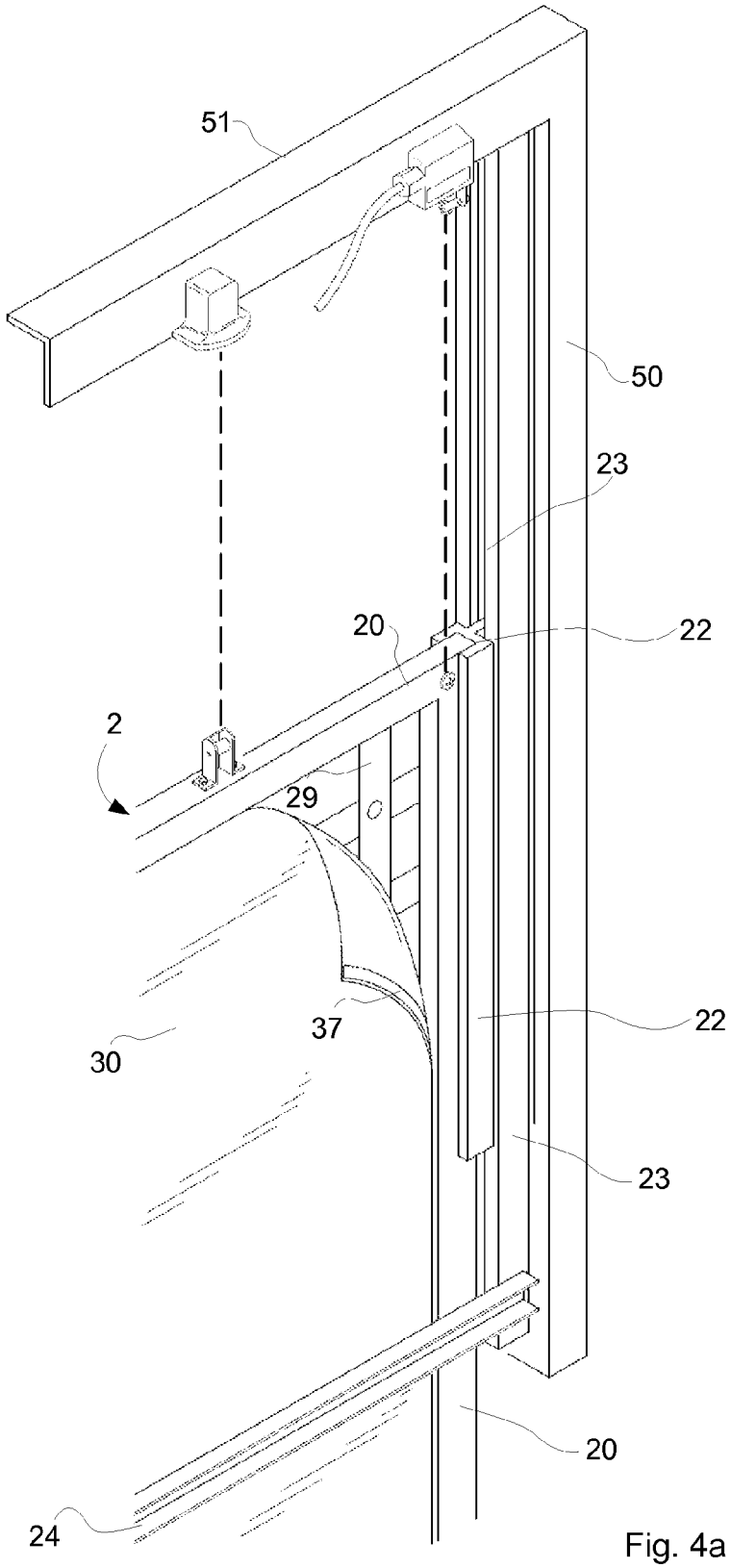
FIGS. 4*a* and 4*b* are rear views of an elevator life safety gate, in accordance with an embodiment of the invention.
Figure 4B:
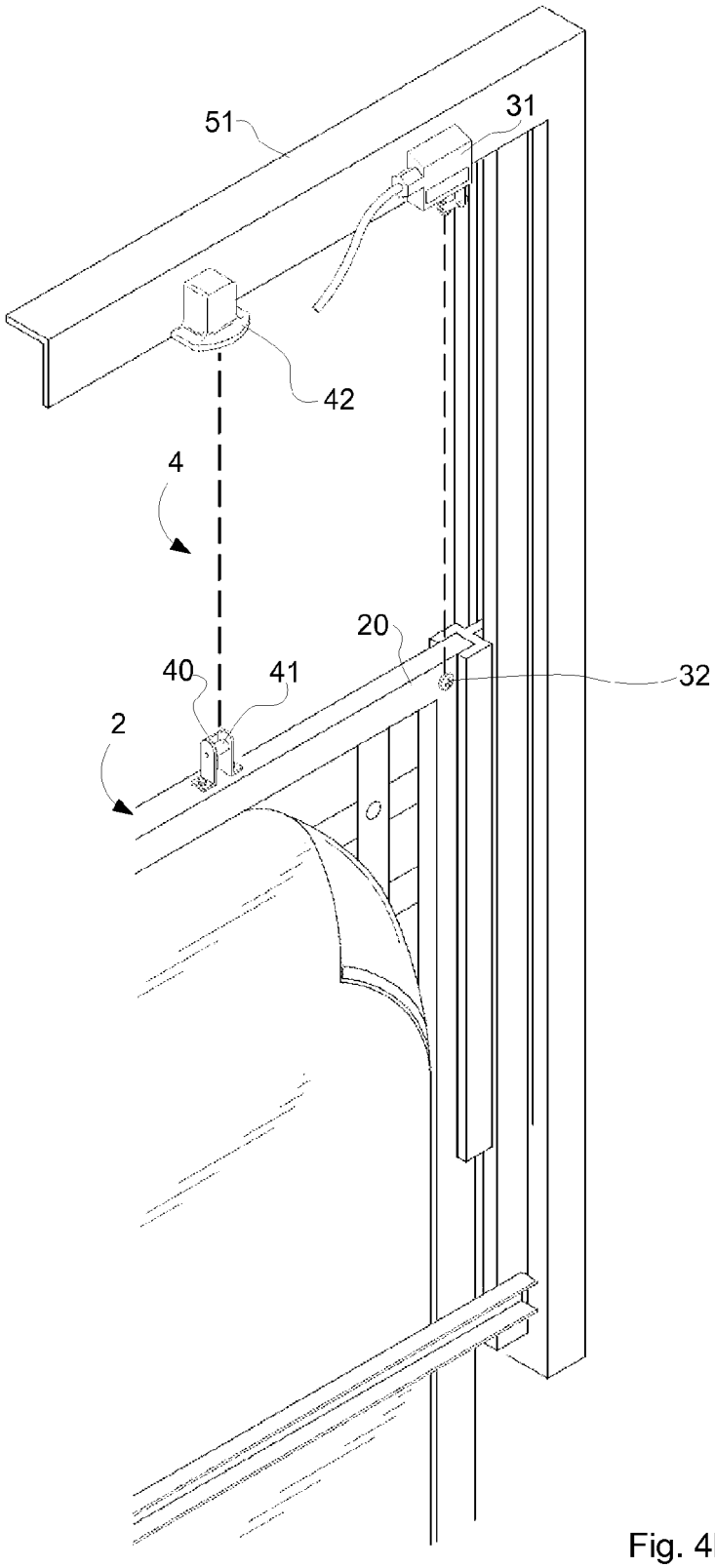

FIGS. 4*a* and 4*b* are rear views of an elevator life safety gate, in accordance with an embodiment of the invention. In some embodiments, an elevator life safety gate 2 may have at least a frame 20, slide rails 22 mounted to the frame 20, slide guides 23 mounted to side mount rails 50, the slide guides 23 configured for receiving the slide rails, a top mount rail 51, an anti-derailment bar 24, a rear lining 30, and a hook-and-loop fastener for the rear lining 37.

In some embodiments, a frame 20 of an elevator life safety gate 2 may be a hollow frame, comprising four bars coupled together defining a generally rectangular gate having an aperture in the center. The hollow frame of the elevator life safety gate 2 may reduce overall weight of the gate, permitting its installation without requiring rebalancing of the elevator car 1 with an elevator counterweight. The hollow frame of the elevator life safety gate 2 may also facilitate use of the webbing 29 of the gate as a ladder as described elsewhere herein. The four bars of the frame 20 may comprise a top bar and a bottom bar oriented horizontally, and a left side bar and right side bar oriented vertically. In a preferred embodiment, a bottom bar is supplemented with a trip wire 25 disposed below the bottom bar (trip wire 25 not shown in FIG. 4*a* but shown in FIG. 8). In different embodiments, a frame 20 of an elevator life safety gate 2 may be a solid gate having no aperture in the center (but may have other apertures as needed for mounting).

Figure 5:
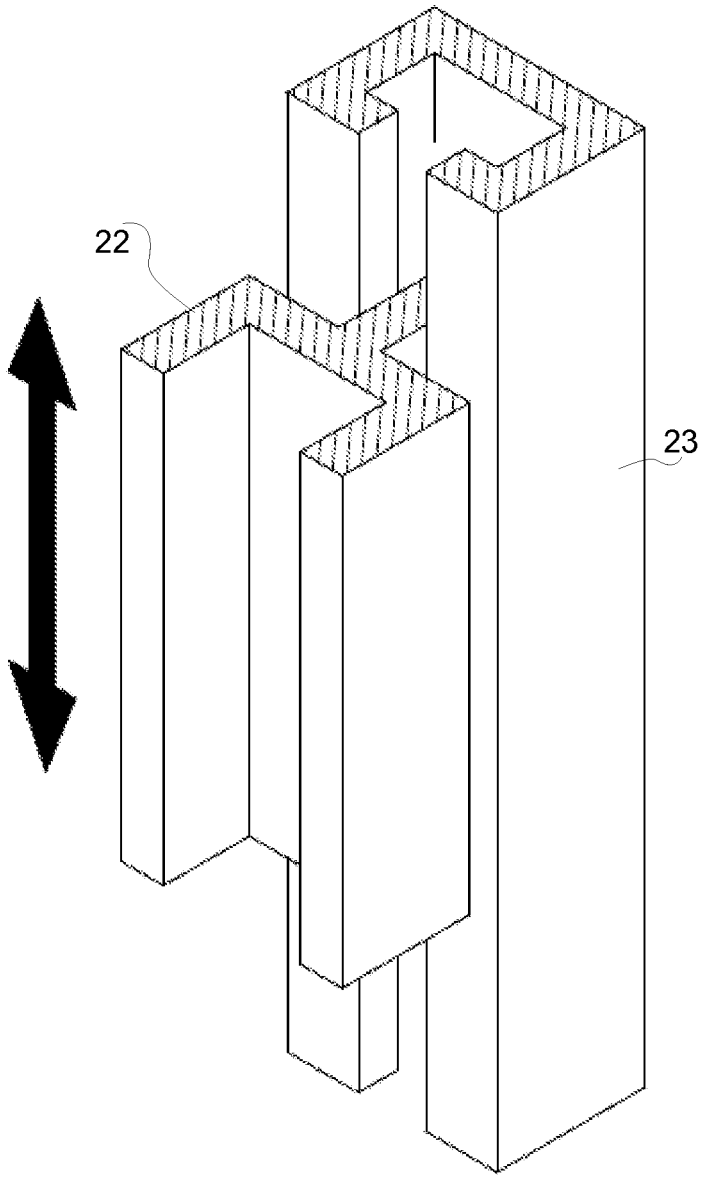
FIG. 5 is a perspective view of a portion of an elevator life safety gate, in accordance with an embodiment of the invention.
Figure 6A:
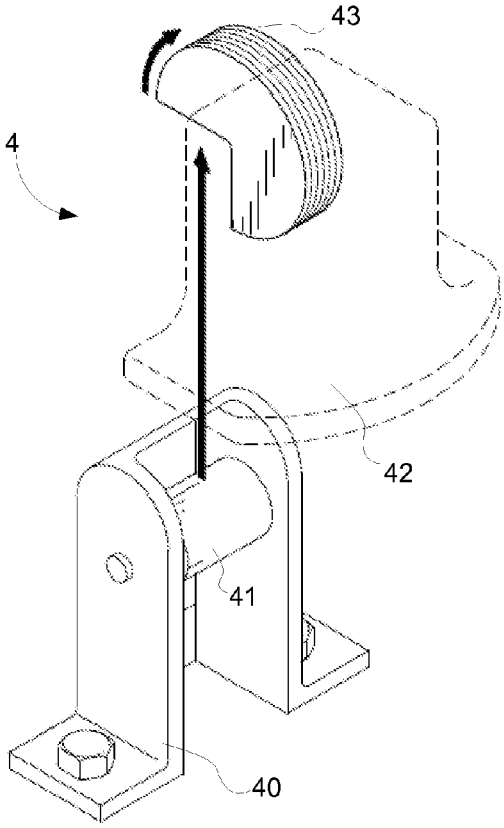
FIGS. 6*a* and 6*b* are perspective views of a portion of an elevator life safety gate, in accordance with an embodiment of the invention.
Figure 6B:
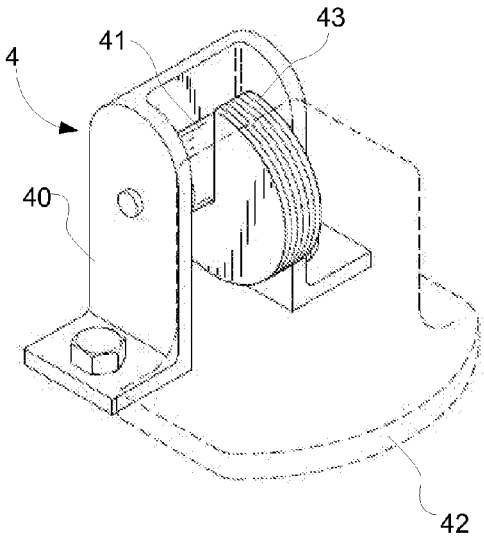

In some embodiments, a frame 20 of an elevator life safety gate 2 may have slide rails 22 coupled to each of the left side and right side of the elevator life safety gate 2. In a preferred embodiment, a toe guard of an elevator has side mount rails 50 and a top mount rail 51 mounted to the back side of the elevator toe guard. To the mount rails are coupled slide guides 23, the slide guides configured for receiving the slide rails 22. As can be seen in FIG. 5, the slide rails 22 have a male portion that interfaces with a female portion of the slide guides 23, making it possible for the entire life safety gate 2 to slide upward and downward relative to the toe guard 5.

In some embodiments, an elevator life safety gate 2 may have a webbing 29 inside the hollow area of the frame 20, the webbing comprising a front face of the gate. In some embodiments, the hollow area of the frame 20 may also have a rear lining 30, the rear lining comprising a rear face of the gate. The rear lining 30 prevents objects or limbs from becoming stuck in the webbing 29 from behind the gate. For example, when a technician is performing maintenance on the elevator and is working in the elevator pit, any tools protruding from a tool belt of the technician will not get stuck in the webbing 29 should the technician brush against the life safety gate 2, because the tools will just deflect against the rear lining 30. However, it may be convenient to quickly remove the rear lining 30, so the rear lining is held in place to the frame 20 with hook-and-loop style fasteners 37. The fasteners 37 may facilitate the breaking away of the rear lining 30 by the foot of a person evacuating the elevator car 1 using the webbing 29.

In some embodiments, an elevator life safety gate 2 may have an anti-derailment bar 24. In some embodiments, an anti-derailment bar 24 is coupled with the slide guides 23 at the bottom of the slide guides 23. An anti-derailment bar 24 prevents deflection of the life safety gate 2 if the life safety gate 2 is subject to pressure from the front side of the life safety gate 2. An elevator code may require that when an elevator is being serviced and the hallway doors are open making the hoistway accessible, a safety yellow colored barricade must be in front of the hallway doors, the barricade able to withstand a force of 200 pounds, for example. This is to prevent a person or object from inadvertently or intentionally falling through the doors into the hoistway. The rear lining 30 is safety yellow colored, and the anti-derailment bar may be configured to withstand a force of 200 pounds against the life safety gate 2 from the front face of the gate. In some embodiments, the foregoing may prevent a person or object from inadvertently or intentionally falling through the doors into the hoistway and satisfy the requirements for a barricade. The anti-derailment bar 24 also provides support from behind the gate if a person climbs out of the elevator car 1 using the webbing 29 on the front of the gate 2.

In some embodiments, an elevator life safety gate 2 may have a check valve to control the rate of extension and retraction of the life safety gate 2 (i.e. the rate at which the gate slides up and down in the slide guides). The check valve may be coupled with a portion of the toe guard or mounting arrangement for the life safety gate 2, and with a portion of the life safety gate 20. In a preferred embodiment, the check valve is mounted to the horizontal toe guard mount rail 51 above the life safety gate 2 and to the top bar of the frame 20 of the life safety gate 2. The check valve may control the rate at which the life safety gate extends and retracts.

Turning to FIG. 4*b*, in some embodiments, an elevator life safety gate 2 may have a top gate catch 4, and a microswitch 31. In some embodiments, an elevator life safety gate 2 may latch into place with the top gate catch 4 when reaching a fully refracted position. This may be desirable when, for example, there is an elevator technician performing maintenance in the elevator pit, and the elevator technician wants to move the life safety gate into a retracted position in order to pass materials underneath the gate from the hallway into the hoistway and vice-versa.

In some embodiments, a top gate catch 4 has a strike 40, the strike 40 having a strike roller 41. A top gate catch 4 also has a handle 42 and a latch 43 (latch 43 not being visible in FIG. 4*b* but visible in FIGS. 6*a* and 6*b*). The top gate catch 4 is operated manually. Sufficient force will cause the top gate catch 4 to engage and to disengage. Thus, to push the life safety gate 4 into a retracted and locked position, one may push the gate upwards until it locks into the top gate catch 4. In some embodiments, the top gate catch 4 may be set to a latch release force of 40 pounds to engage and disengage the latch 43. The top gate catch 4, comprising the strike 40 and handle 42 may be, for example, a Brixon Item #2PASCI (#2 Latch Body and Adjustable Strike). The strike 40 may be mounted to the top of the frame 20, and the handle 42 may be mounted to the top mount rail 51. When the life safety gate is raised upwards so that the strike 40 enters the handle 42, as can be seen more clearly in FIGS. 6*a* and 6*b*, the strike roller 41 engages the latch 43 and rotates the latch 43 into a locked position, so that the latch 43 when rotated supports the life safety gate 2. The life safety gate 2 may be pulled downward with a force more than the set latch release force to rotate the latch 43 in the other direction, permitting the life safety gate 2 to travel downwards.

Figure 7:
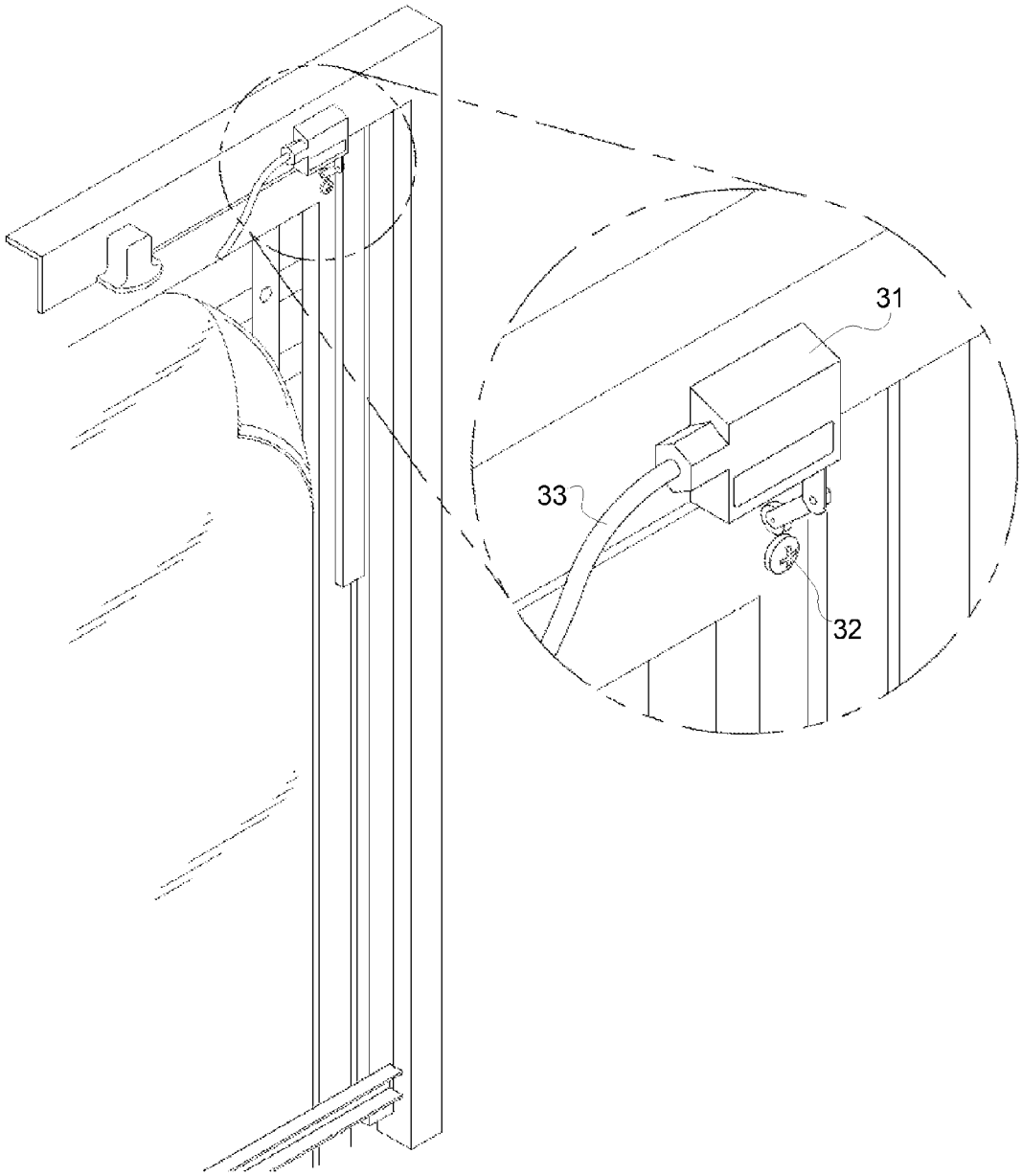
FIG. 7 is a perspective view of a portion of an elevator life safety gate, in accordance with an embodiment of the invention.

In some embodiments, it may be advantageous to operate the elevator's emergency stop circuit if the life safety gate 2 is fully retracted and latched. For example, if the elevator car is traveling downward in the hoistway, and the life safety gate 2 comes into contact with an object or a person in the hoistway. This may occur should there be an elevator technician in the pit and another individual inadvertently sends the elevator downward. Should the bottom of the life safety gate 2 hit the object or person causing the gate to fully retract and latch, halting the travel of the elevator may save the life of the person in the pit and/or prevent damage to the object or to the elevator. Consequently, in some embodiments, an elevator life safety gate 2 may have a microswitch 31, operated by a microswitch bumper 32, and signaling the emergency stop circuit through a microswitch signal cable 33. The microswitch 31 may be coupled in a normally-open style circuit with the elevator emergency stop circuit. As can be seen in FIG. 7, when the life safety gate has traveled upward into a refracted and latched position, the microswitch bumper 32 comes into contact with the microswitch 31, causing the microswitch 31 to activate the elevator emergency stop circuit via the microswitch signal cable 33.

In some embodiments, an elevator life safety gate 2 may have an additional latch accessible from the hallway for latching the gate in a retracted position. The additional latch may be, for example, a barrel slide bolt latch. This latch could be engaged, for example, by a technician wishing to enter the hoistway and elevator pit from the hallway, and would provide an additional way of latching the gate which would not be able to be overcome by the force with which the top gate catch could be disengaged.

Figure 8:
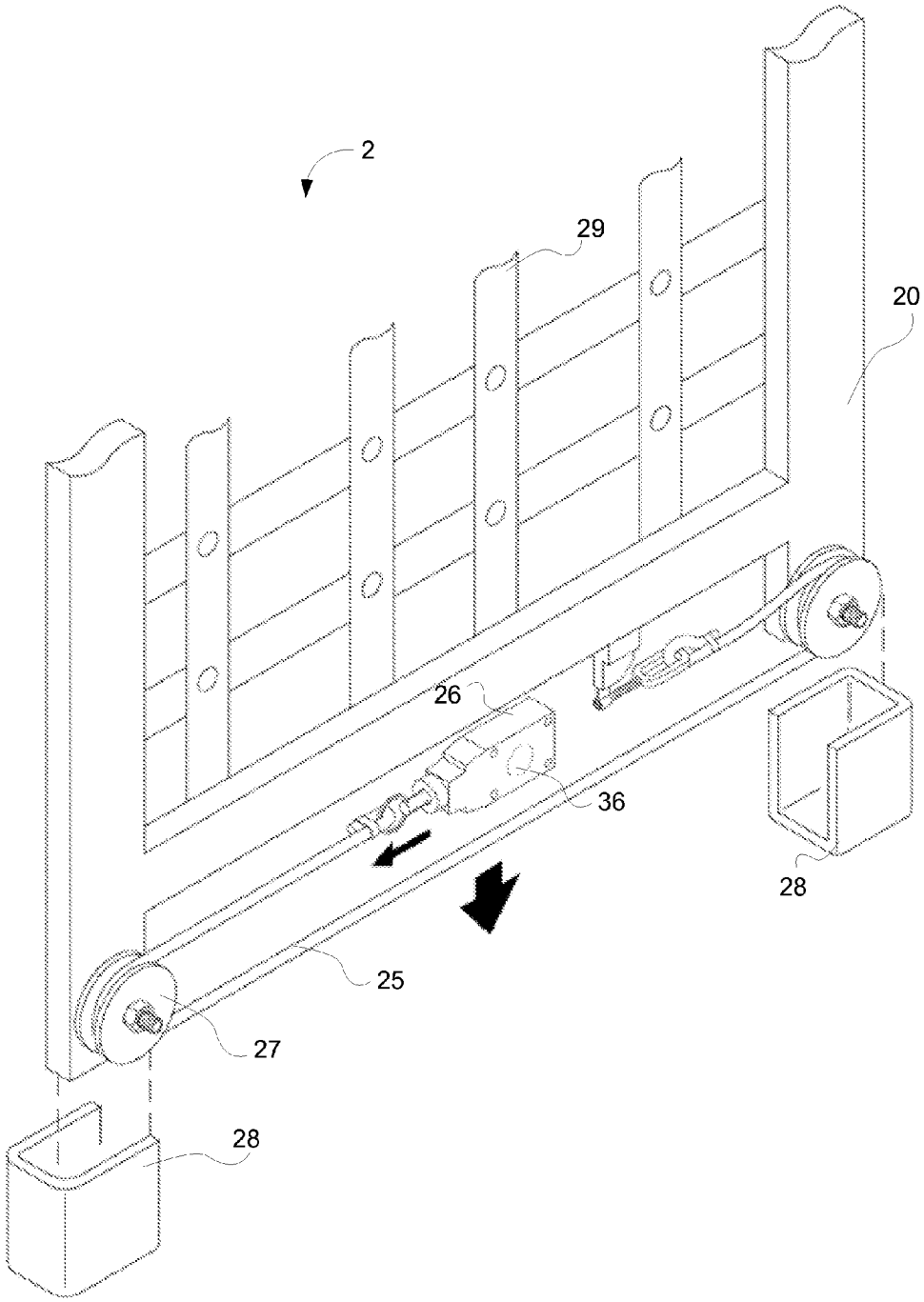
FIG. 8 is a perspective view of a portion of an elevator life safety gate, in accordance with an embodiment of the invention.

FIG. 8 is a perspective view of a portion of an elevator life safety gate, in accordance with an embodiment of the invention. In some embodiments, a life safety gate 2 may have a trip wire 25, a trip wire stop switch 26, one or more trip wire sheaves 27, and one or more rubber bumpers 28.

In some embodiments, an elevator life safety gate 2 may have a trip wire 25, the trip wire 25 defining a bottom edge of the life safety gate 2. The trip wire may be wrapped around one or more trip wire sheaves 27 and connected to a trip wire stop switch 26. The trip wire stop switch 26 may be wired in series with the elevator emergency stop switch, so that if the trip wire 25 is tripped, activating the trip wire stop switch 26, the elevator emergency stop circuit is also engaged, halting the elevator. This may be advantageous to an elevator technician working in the pit who needs to quickly halt the elevator and may do so by merely pulling on the trip wire 25, where a trip wire 25 might be more easily accessible than an emergency switch mounted in the hoistway. A trip wire 25 may also be activated should the elevator be traveling downward and encounter an object or person in the hoistway. Halting the travel of the elevator in this scenario may prevent harm to the person and/or prevent damage to the object or the elevator. A trip wire stop switch 26 may have a trip wire reset 36, facing the hoistway, so that a technician can resume operation of the elevator easily by pressing the trip wire reset 36. In some embodiments, the trip wire 25 may be covered with a yellow vinyl trip wire cover 38 (vinyl trip wire cover not visible in FIG. 8 but may be seen in FIG. 9), through which the trip wire 25 and the trip wire reset 36 could still be activated. The trip wire cover 38 may be mounted to the frame 20 with hook-and-loop style fasteners.

In some embodiments, an elevator life safety gate 2 may have one or more bumpers 28 at the bottom of the gate 2. In some embodiments, one or more rubber bumpers 28 may cover the trip wire sheaves 27. A rubber bumper 28 may reduce noise should the gate come into contact with the elevator pit, and can cushion impact should the gate come into contact with an object or a person.

Figure 9:
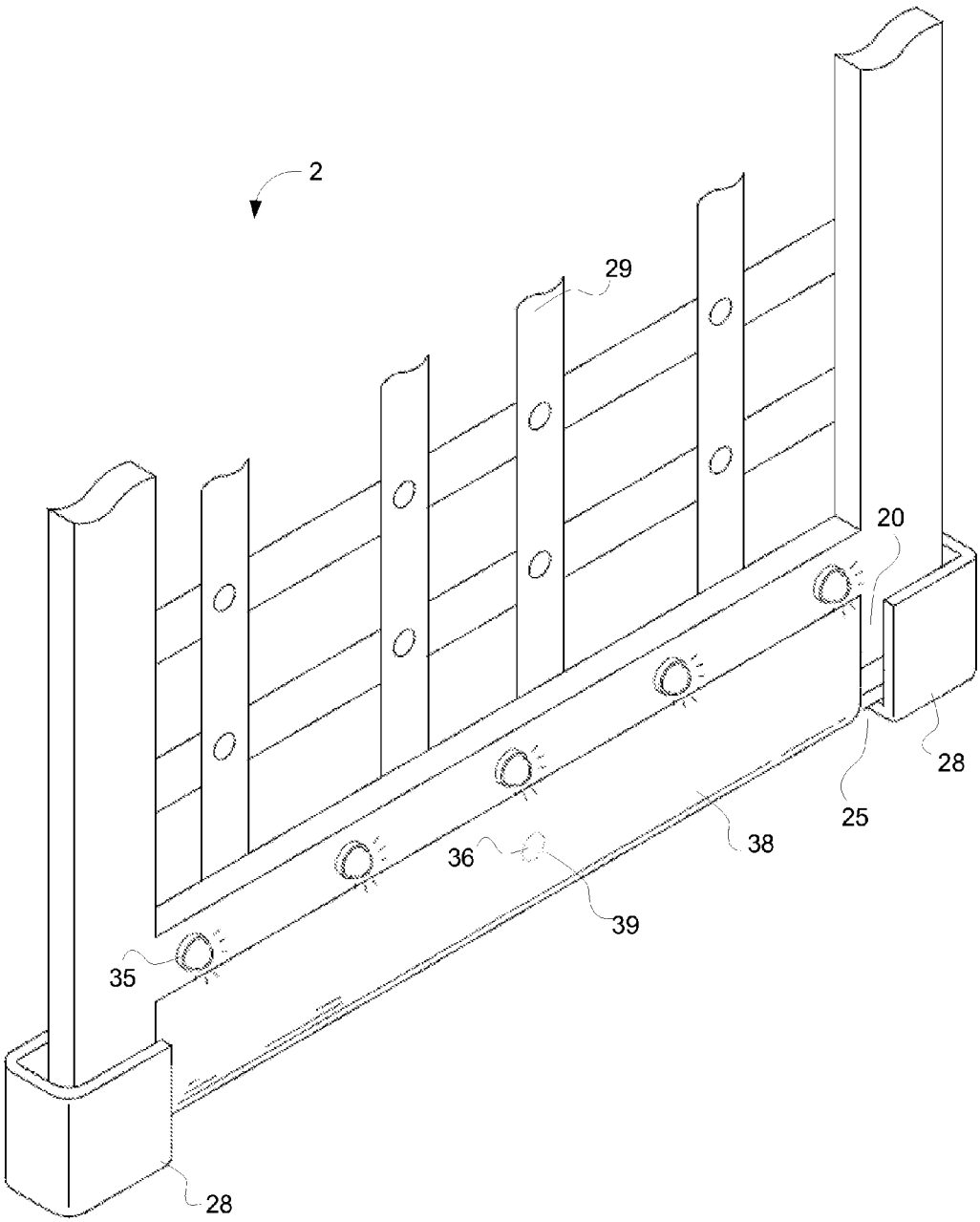
FIG. 9 is a perspective view of a portion of an elevator life safety gate, in accordance with an embodiment of the invention.

FIG. 9 is a perspective view of a portion of an elevator life safety gate, in accordance with an embodiment of the invention. In some embodiments, a life safety gate may have a yellow vinyl trip wire cover 38. The vinyl trip wire cover 38 may couple with the frame 20 and cover the trip wire 25, the coupling being achieved with hook-and-loop fasteners, for example. The vinyl construction of the trip wire cover 38 ensures that the trip wire 25 could still be activated through the cover. The vinyl trip wire cover 38 may have an aperture 39 disposed through the center of the trip wire cover 38 to permit access to the trip wire reset 36.

In some embodiments, one or more lights 35 may be disposed along a portion of the frame 20. The lights may be operated to provide additional light to the elevator hoistway and pit when needed. The lights may also be operated to provide a status signal related to operation of the elevator. The status signal may be color coded, for example, including red meaning the elevator emergency stop switch is not engaged (and thus the elevator is in a possibly unsafe status for anyone viewing the lights from the pit), or green indicating that at least one of the emergency stops have been engaged.

Figure 10:
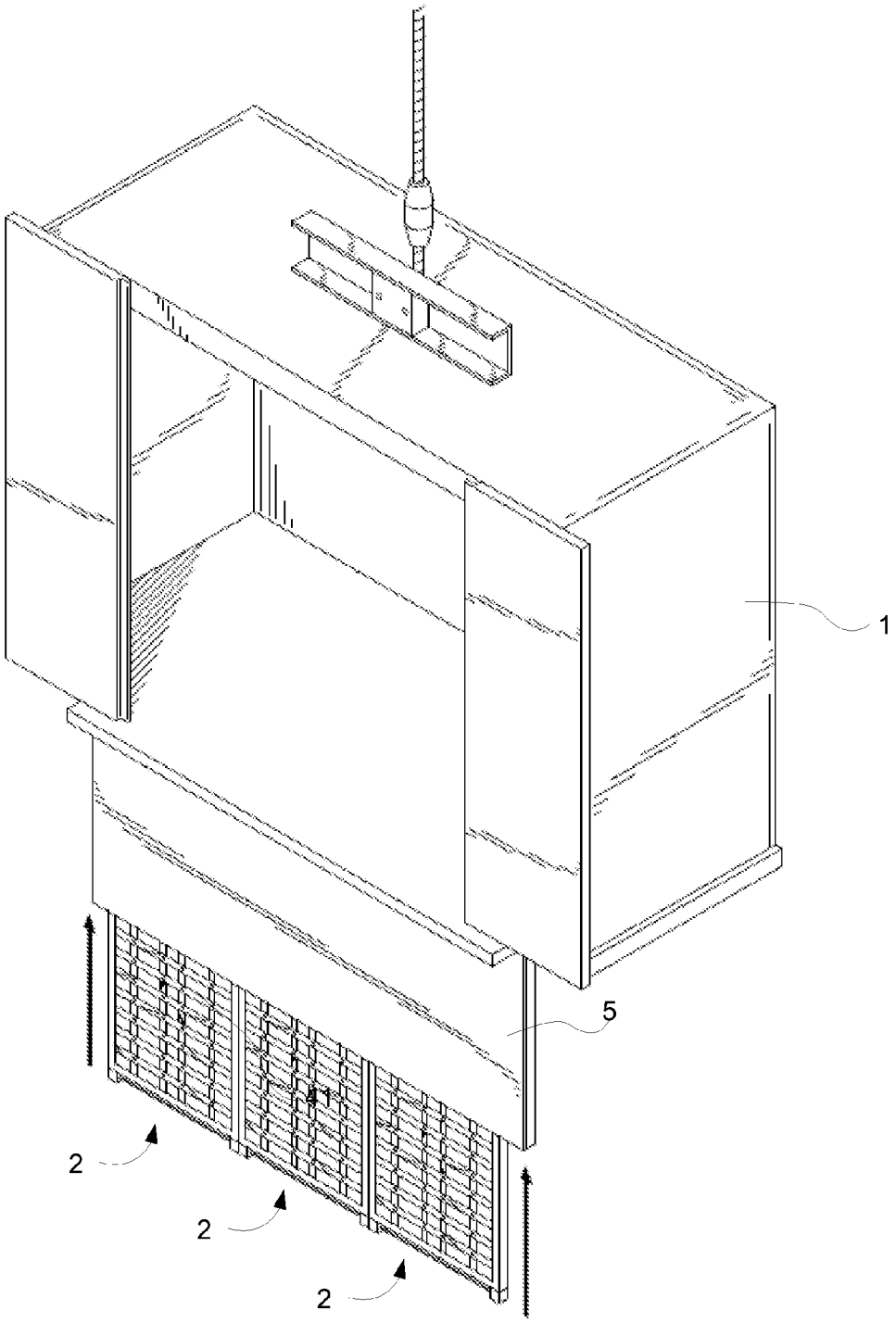
FIG. 10 is a perspective view of a portion of an elevator life safety gate, in accordance with an embodiment of the invention.

FIG. 10 is a perspective view of an elevator life safety gate, in accordance with an embodiment of the invention. In some embodiments, an elevator may have a plurality of life safety gates 2 mounted side-by-side. This may desirable, for instance, in the case of a freight elevator or other particularly wide elevator. A plurality of gates mounted side-by-side is advantageous over one particularly wide gate, because the anti-derailment will be provided by a portion of each individual gate. The anti-derailment bar, discussed elsewhere herein, mitigates an impact from the hallway side of the gates. If one particularly wide gate were implemented, an impact would be braced by a very wide anti-derailment bar supported mounts at the far ends of the elevator. Using a plurality of gates ensures that an impact would be braced by a shorter anti-derailment bar that is supported by mounts close to the point of impact, and less deflection would be possible. Lighter-weight anti-derailment bars may thus be used.

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An elevator life safety gate, comprising:

a frame, the frame slidably mounted to a toe guard of the elevator car and including at least an aperture disposed through a center region of the frame; and a lattice of horizontal and vertical straps, the lattice of horizontal and vertical straps disposed within the center region of the frame wherein at least a portion of the lattice of horizontal and vertical straps is fixedly coupled with the frame, the lattice of horizontal and vertical straps configured for enabling a human to climb the lattice, wherein at least a portion of the elevator life safety gate is configured to extend below a bottom edge of the toe guard.

2. The elevator life safety gate of claim 1, further comprising:

a top gate catch including at least a latch, a strike and a strike roller, the top gate catch configured to engage the frame and latch when the frame is fully retracted, the top gate catch including at least a configurable latch release force.

3. The elevator life safety gate of claim 2, wherein operation of the elevator is prevented when the frame is fully retracted.

4. The elevator life safety gate of claim 1, wherein the frame includes at least a slide rail arrangement, wherein the slide rail arrangement is received by one or more slide guides fixedly coupled with the toe guard of the elevator car.

5. The elevator life safety gate of claim 4, further comprising:

one or more anti-derailment bars fixedly coupled to the one or more slide guides.

6. The elevator life safety gate of claim 4, further comprising:

one or more anti-derailment bars mounted transversely to the one or more slide guides.

7. The elevator life safety gate of claim 1, wherein the frame includes at least a slide rail arrangement, wherein the slide rail arrangement is received by one or more slide guides fixedly coupled with one or more side mount rails fixedly coupled to the toe guard of the elevator car.

8. The elevator life safety gate of claim 1, wherein the lattice of horizontal and vertical straps comprises:

a lattice of horizontal and vertical straps enabling a human to climb at least one of into or out of the elevator car.

9. The elevator life safety gate of claim 1, wherein the frame comprises:

a frame including at least four bars coupled together defining the frame in a generally rectangular orientation and an aperture disposed through a center region of the frame.

10. The elevator life safety gate of claim 1, wherein the frame comprises:

a frame configured to slide upward and downward relative to the toe guard.

11. The elevator life safety gate of claim 1, further comprising:

at least another frame including at least another lattice of horizontal and vertical straps disposed within a center region of the at least another frame, wherein the plurality of frames are mounted adjacent to one another.

12. The elevator life safety gate of claim 1, further comprising:

one or more status lights, the one or more lights configured for enabling a human to view a status of an elevator emergency stop switch.

13. The elevator life safety gate of claim 1, further comprising:

one or more emergency lights, the one or more emergency lights configured for providing extra light for visibility of the elevator hoistway.

14. The elevator life safety gate of claim 1, wherein the elevator life safety gate is configured to slide upward and downward relative to the toe guard.

15. An elevator life safety gate, comprising:

a frame, the frame including at least an aperture disposed through a center region of the frame;

a switch, the switch accessible from below the elevator car, the switch configured for controlling the elevator when the switch is operated, the switch including at least:

a trip wire stop switch;

one or more trip wire sheaves; and a trip wire, the trip wire defining a bottom edge of the frame, wherein the trip wire is wrapped around the one or more trip wire sheaves and connected to the trip wire stop switch; and a lattice of straps, the lattice of straps disposed within the center region of the frame wherein at least a portion of the lattice of straps is fixedly coupled with the frame, the lattice of straps configured for enabling a human to climb the lattice, wherein the elevator life safety gate is configured to extend from underneath an elevator car.

16. An elevator life safety gate, comprising:

a frame, the frame including at least an aperture disposed through a center region of the frame;

a lining, the lining disposed within the center region of the frame; and a lattice of straps, the lattice of straps disposed within the center region of the frame wherein at least a portion of the lattice of straps is fixedly coupled with the frame, the lattice of straps configured for enabling a human to climb the lattice, wherein the elevator life safety gate is configured to extend from underneath an elevator car.

17. The elevator life safety gate of claim 16, wherein the lining comprises:

a lining removably attached to the frame.

18. The elevator life safety gate of claim 16, wherein the lining comprises:

a lining disposed within the center region of the frame behind the lattice of straps.

19. An apparatus for blocking access to an elevator shaft, comprising:

a vertically oriented left side bar received by a first slide guide, the first slide guide mounted to a back side of an elevator toe guard substantially adjacent to a left edge of the elevator toe guard;

a vertically oriented right side bar received by a second slide guide, the second slide guide mounted to the back side of the elevator toe guard substantially adjacent to a right edge of the elevator toe guard;

one or more horizontal straps fixedly coupled with the left and right side bars;

one or more vertical straps fixedly coupled with the one or more horizontal straps, the one or more horizontal and vertical straps arranged to define a ladder;

a horizontally oriented bottom bar fixedly coupling the left and right side bars; and one or more rods mounted to the first and second slide guides, the one or more rods disposed behind the bars, the one or more rods operable to resist deflection against the apparatus from a side of the apparatus opposite the elevator shaft.

* * * * *